US005090319A

United States Patent [19]

Weber et al.

[11] Patent Number: 5,090,319

[45] Date of Patent: Feb. 25, 1992

[54] PRINTING UNIT CYLINDER FOR A ROTARY PRINTING MACHINE

[75] Inventors: Werner Weber; Markus Gerstenberger, both of Sandhausen, Fed. Rep. of Germany

[73] Assignee: Heidelberger Druckmaschinen AG, Heidelberg, Fed. Rep. of Germany

[21] Appl. No.: 621,665

[22] Filed: Dec. 3, 1990

[30] Foreign Application Priority Data

Dec. 1, 1989 [DE] Fed. Rep. of Germany ..... 3939725
Nov. 2, 1990 [DE] Fed. Rep. of Germany ..... 4034767

[51] Int. Cl.[5] ..... B41F 1/28; B41F 21/00

[52] U.S. Cl. ..... 101/483; 101/375; 101/415.1

[58] Field of Search ..... 101/415.1, 375, 379, 101/216, 219, 483, 485

[56] References Cited

U.S. PATENT DOCUMENTS 2,714,852 8/1955 Stempel ..... 101/415.1
3,181,448 5/1965 Hemenway ..... 33/619 X
4,742,769 5/1988 Zeller ..... 101/415.1 X
4,790,245 12/1988 Fischer et al. ..... 101/415.1 X
4,815,380 3/1989 Fischer ..... 101/415.1 X

FOREIGN PATENT DOCUMENTS 150573 9/1981 German Democratic Rep. ..... 101/415.1

*Primary Examiner*—Edgar S. Burr
*Assistant Examiner*—Moshe I. Cohen
*Attorney, Agent, or Firm*—Nils H. Ljungman & Associates

[57] ABSTRACT

The invention relates to a printing unit cylinder for a rotary printing machine comprising a gap strip arranged in a cylinder gap of said printing unit cylinder, said gap strip being supported on the bottom of said cylinder gap, being removably fastened via a fastening means and being of resilient design in order to achieve a reliable vibration absorption in the area of the cylinder gaps.

20 Claims, 3 Drawing Sheets

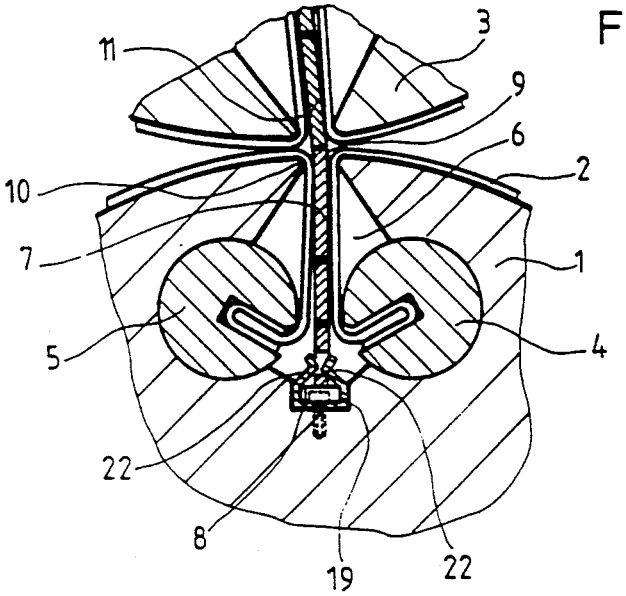
Fig. 1
Fig. 2
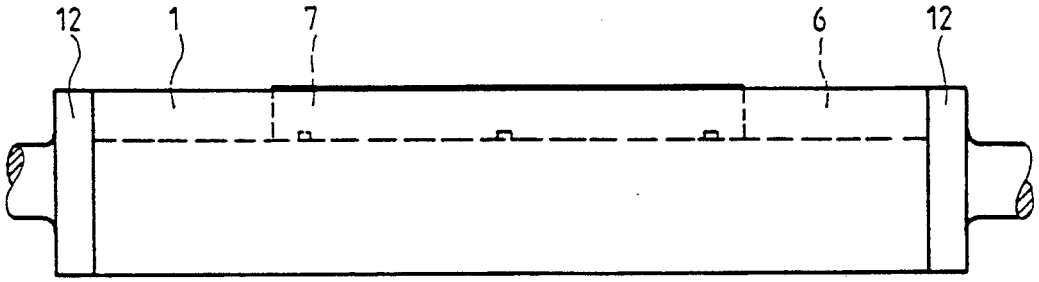

PRINTING UNIT CYLINDER FOR A ROTARY PRINTING MACHINE

BACKGROUND OF THE INVENTION

1. Field of the Invention

The invention relates to a printing unit cylinder for a rotary printing machine and, more particularly, to a gap strip positioned in the cylinder gap of the printing unit cylinder. The gap strip is supported on the bottom of said cylinder gap and is removably fastened in the cylinder gap. The gap strip extends from the gap a distance to permit gap strips of two cooperating cylinders to contact each other.

2. Background Information

In printing plate cylinders and blanket cylinders of an offset rotary printing press, it is known to insert an element in the cylinder groove or gap for absorbing shocks and vibrations imparted to the cylinder. U.S. Pat. No. 4,742,769 discloses a filler element inserted in a cylinder gap or groove that extends axially on the cylinder. The filler element is strip-like in shape and is supported on the bottom of the cylinder gap. The filler element is of lesser axial length than the cylinder. The filler element is operable to absorb shocks which occur in the area of the cylinder gaps by cooperating with a filler element in an adjacently positioned cylinder. As further disclosed in U.S. Pat. No. 4,742,769 and also in U.S. Pat. No. 4,815,380, the filler element extends over flattened regions of the cylinder at the gap opening. This arrangement results in a rigid mounting of the filler element in the gap.

It is known that the contact between the elastic blanket on the blanket cylinder and the rigid filler element generates considerable shocks when two adjacently positioned cylinders roll across each other, resulting in vibrations of the cylinders. Adapting the outer contour of the filler element to the theoretical diameter of the cylinder cannot prevent the vibrations from occurring, especially in view of the interaction of blankets with different degrees of hardness and the cooperation between a blanket and printing plate in another cylinder combination. These attempts to eliminate the effects of vibrations, which are detrimental to the printed image, have not proved to be satisfactory.

U.S. Pat. No. 4,790,245 discloses a support assembly for a cylinder groove in a plate or blanket cylinder of a rotary printing machine. The support assembly includes a support bar attached to a holding rail at the bottom of the groove in a manner to permit adjustments in the height of the support bar with respect to the theoretical diameter of the cylinder. The support bar is connected to the holding rail by a tensioning device which consists of individual parts featuring inclined areas that facilitate adjustments to the height of the support bar in the groove. Disadvantages result with this adjustment assembly in the operation of the printing machine producing cylinder wash-up, penetration of dust and solvents into the adjustment assembly and solidification shortly afterwards. Thus, this known solution does not permit sensitive adjustment of the support bar in sustained operation of the printing press. Moreover, the change of blankets or printing plates requires complicated procedures when removing the parts of the support bar from the cylinder gap and putting them in place again after having changed blankets and printing plates.

U.S. Pat. No. 2,714,852 discloses another example of a bar member positioned in the axial groove of a printing press transfer cylinder. The bar member is used to tension the ends of the transfer blanket and snugly draw the blanket around the periphery of the cylinder.

While it is known to provide a gap strip of a transfer cylinder or the like in a rotary printing press to reduce shocks and vibrations, the known strips require complicated mounting means and do not satisfactorily reduce vibrations. Therefore, there is need to provide a simple construction which is easy to insert in the cylinder gap, and which guarantees reliable vibration absorption in the area of the cylinder gap.

SUMMARY OF THE INVENTION

In accordance with the present invention, there is provided a printing plate cylinder for rotary printing press that includes a plate cylinder having a surface positioned to coact with a surface of an adjacently positioned cylinder of the rotary printing press. The cylinder surface has a gap extending longitudinally on the plate cylinder. The gap has an open upper end portion at the surface of the gap and a bottom end portion. A gap strip is positioned in the gap. Fastening means positioned in the gap removably retain the gap strip in the gap to extend to an elevation above the cylinder surface for interaction with a gap strip on an adjacently positioned cylinder. The gap strip has a plate-like body portion with an upper edge portion. Means are positioned on the strip adjacent the upper edge portion for resiliently supporting the strip on the cylinder in the area of the groove to permit deflection of the strip and absorption of vibrations in response to pressure applied to the cylinder in the operation of the rotary printing press.

Another feature of the present invention is directed to a rotary printing press having a cylinder formed with a axial groove on the surface of the cylinder. A strip of resilient material is positioned in the groove. The strip has an outer portion projecting from the groove and inner portion positioned within the groove. Fastening means releasably secures the strip in the groove. The fastening means is connected to the strip inner portion. The strip outer portion has a surface overlying the groove. Means is positioned on the strip surface for resiliently supporting the strip on the cylinder in the area of the groove to permit deflection of the strip and absorption of vibrations in response to pressure applied to the cylinder in the operation of the rotary printing press.

An additional feature of the present invention includes a method for resiliently supporting a gap strip on the surface of a transfer cylinder for a rotary printing press that includes the steps of removably supporting a gap strip in a gap extending longitudinally on the surface of a transfer cylinder. An upper edge of the gap strip projects from the gap above the surface of the transfer cylinder for interaction with a gap strip of an adjacently positioned cylinder of the rotary printing press. The gap strip is divided into a plurality of zones along the length of the gap strip. The zones flex relative to one another to permit the surface of the gap strip to deflect above the gap. Vibrations imparted to the transfer cylinder from the adjacently positioned cylinder in the operation of the rotary printing press is absorbed by elastic movement of the zones of the gap strip.

A principal object of the present invention is to provide a gap strip for a cylinder gap of a printing unit cylinder where the gap strip is operable to absorb vibrations in the area of the gap and is easily inserted and removed from the gap.

Another object of the present invention is to provide a gap strip for a rotary printing press transfer cylinder in which the strip is divided into individual zones having reduced mass to provide the respective zones with points of low inertia which permit relative movement of the zones, one with respect to another, and elastic rebounding of the outer contour or edge of the gap strip when two gap strips of adjacently positioned cylinders come in contact with each other.

An additional object of the present invention is to provide cooperating cylinders in an offset rotary printing press with elastic gap strips that serve to maintain a constant role-off pressure between the two cylinders in the area of the cylinder gaps.

A further object of the present invention is to provide gap strips of selected resilience to be used with blanket cylinders and transfer cylinders where the elasticity of the gap strip is determined by the support pressure of the flexible blanket or printing plate on the cylinder.

BRIEF DESCRIPTION OF THE DRAWINGS

FIG. 1 is a fragmentary cross-sectional view of a pair of printing plate cylinders, illustrating contacting gap strips for absorbing cylinder vibrations.

FIG. 2 is a schematic view in side elevation of a printing unit cylinder, illustrating the longitudinally extending gap strip shown in FIG. 1.

DESCRIPTION OF THE PREFERRED EMBODIMENTS

Figure 3:
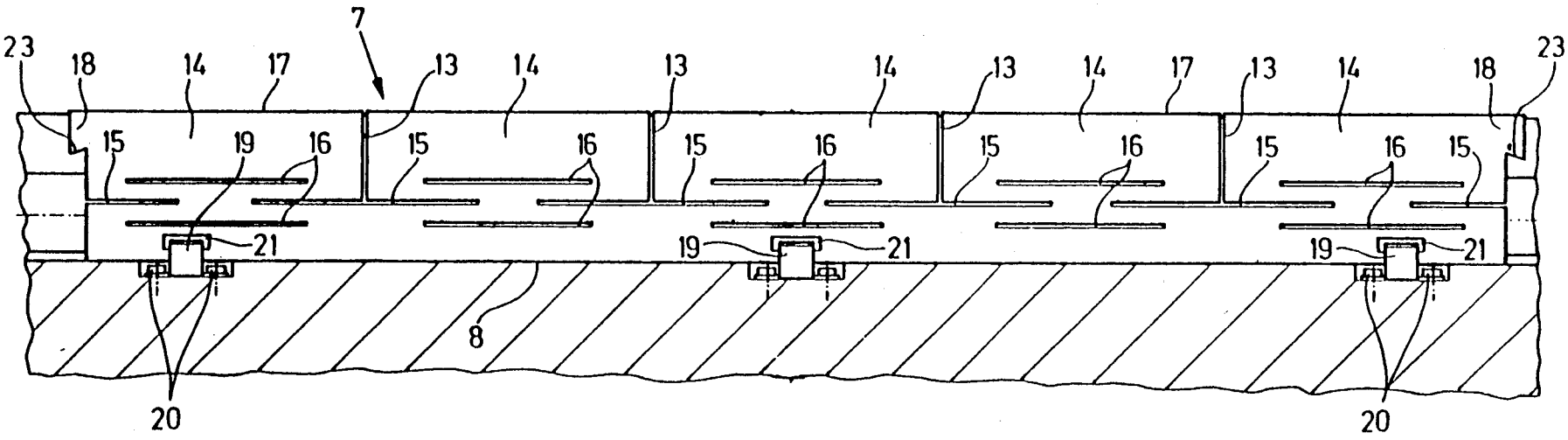
FIG. 3 is a fragmentary cross-sectional view of a gap strip in the cylinder gap.

Referring to FIGS. 1 and 2 there is illustrated a printing unit cylinder 1 of a rotary printing press with a flexible blanket 2 positioned in a known manner on the cylinder. The cylinder 1 may cooperate with an adjacently positioned counter-cylinder 3 in operation of the offset printing process performed by the rotary printing press. The blanket 2 is tensioned via two tensioning spindles 4 and 5 arranged in a cylinder gap or groove 6. The blanket tensioning spindles 4 and 5 secure and stretch the two ends of the flexible blanket 2 over the surface of the blanket cylinder 1. The same arrangement is used to secure a flexible printing plate to a printing plate cylinder. The apparatus for securing and tensioning a flexible blanket or printing plate to a transfer cylinder is beyond the scope of the present invention and is disclosed in detail in U.S. Pat. Nos. 2,714,852; 4,742,769; 4,790,245; 4,815,380, which are incorporated herein by reference.

In the cylinder gap 6 there is also arranged a gap or cover strip 7 between the two ends of the blanket 2 or printing plate. The gap strip 7 is supported on a bottom 8 of the cylinder gap 6. The gap strip 7 is designed such that it contacts a corresponding gap strip 11 in the adjacently positioned cylinder 3 which cooperates with the cylinder 1 in the offset printing operation.

As shown in FIG. 2, the printing unit cylinder 1 includes the inserted gap strip 7 which extends longitudinally on the cylinder 1 in gap 6. The gap 6 is axially positioned on the cylinder unit 1. The front ends of the printing unit cylinder 1 are also provided with bearing rings 12 for rotatably supporting the cylinder 1.

The strip or cover 7, which is positioned in the cylinder gap or groove 6, is shown in detail in FIG. 3 as a longitudinally extending plate divided into individual zones 14 by transversely extending slits 13. In the longitudinal direction of the gap strip 7, the individual zones 14 are provided with a plurality of longitudinal slits 15 and 16. The length of the slits 15 and 16 is selective to provide the plate with a preselected degree of resilience or elasticity, as determined by the support pressure of the blanket 2 on the cylinder 1. As shown in FIG. 3, and also with the embodiment shown in FIG. 4, the slits 15 and 16 are spaced apart in substantial parallel relation. However, it should be understood that the slits 15 and 16 may be perforations of selected size and randomly positioned in the zones 14 to allow elastic deformation of the gap strip 7 in absorbing shocks and vibrations.

As illustrated in FIG. 3, the transverse slits 13 extend from the surface or outer contour 17 of the strip 7 into communication with the longitudinal slits 15. This arrangement divides the strip 7 into a plurality of zones 14, thus enabling an independent elastic rebounding of the outer contour or edge 17 of the gap strip 7. The support pressure of a blanket cylinder may range between 1200 and 1600 Newtons. The perforations or slits 13, 15 and 16 provide the gap strip 7 with an elastic resilience which corresponds to the support pressure of the blanket 2 on cylinder 1.

In operation a gap strip 7 is selected corresponding to the respective surface quality of a cylinder 1 is inserted in the cylinder gap 6. The gap strip 7 selected is designed with the slits 13, 15 and 16 or perforations that give the strip 7 the elastic resilience which corresponds to the support pressure of the cylinder blanket 2. Therefore, a plurality of strips of differing elasticity are available for insertion in the gap 6 depending on the press conditions.

As seen in FIG. 3 in the end region 18 of the gap strip 7, the longitudinal slits 16 are longer than in the middle of the gap strip 7 so that the support pressure is reduced and the outer contour 17 of the gap strip can adapt itself to the cylinder deflection. Furthermore, the two end regions 18 are provided with hooks 23 which facilitate efficient removal of the gap strip 7 from the gap cylinder 6. It is advantageous to arrange the gap strips 7 and 11, as shown in FIG. 1, for the adjacently positioned cylinders 1 and 3 midway along the length of the cylinders, as shown in FIG. 2. Preferably, the gap strips 7 and 11 each have a length that corresponds at least half the cylinder length and to have outer contour 17 project between 0.2 mm and 0.25 mm beyond the theoretical diameter of the cylinder. Due to the projecting of the two cooperating gap strips 7 and 11 before the median line of the two cylinders 1 and 3, the support pressure is absorbed by the gap strips 7 and 11 and is removed from the cylinder gap so that a pulse-like or oscillatory force buildup causing disadvantageous vibrations of the cylinders 1 and 3 is avoided.

On the bottom 8 of the cylinder gap 6 retaining springs 19 are fastened by screws 20, as shown in FIGS. 1 and 3. For securing the gap strip 7, the gap strip is provided in the area of retaining springs 19, with slits 21 in which spring legs 22 of the springs 19 engage the bottom of the gap strip 7. This guarantees a firm mounting of the gap strip during machine operation; furthermore, the gap strip 7 is fastened such that it can easily be inserted and removed.

Figure 4:
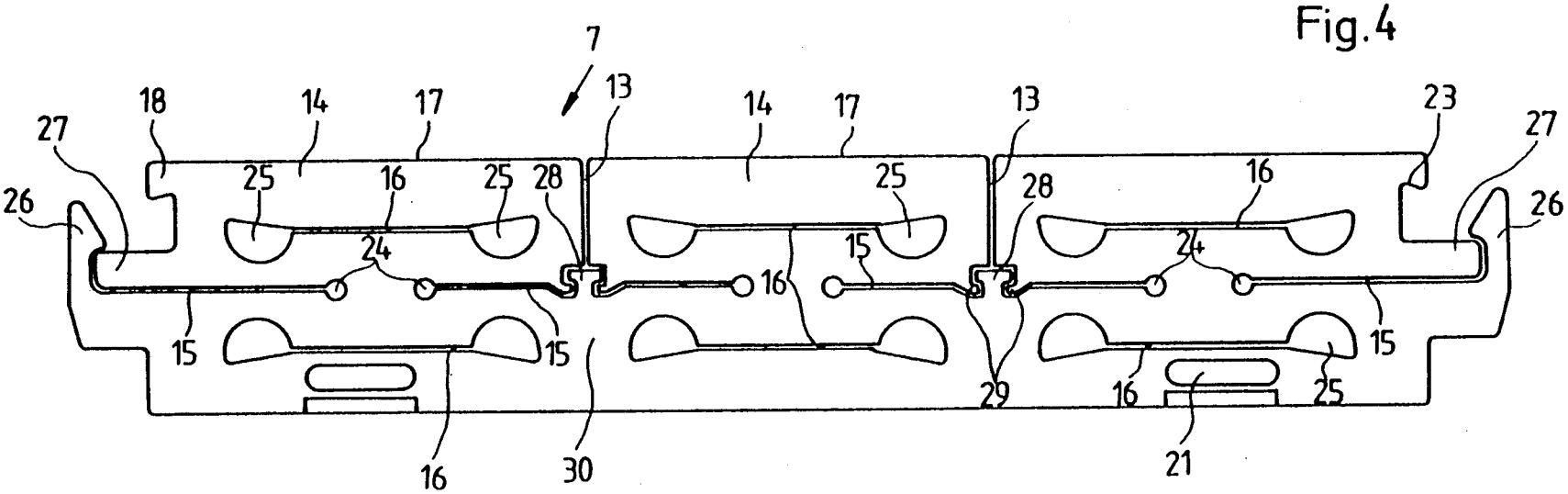
FIG. 4 is a view in side elevation of another embodiment of a gap strip.

The gap strip 7 shown in FIG. 4 features recesses or perforations 24 and 25 at the ends of the longitudinal slits 15 and 16. The recesses or perforations 24 and 25 and the slits 13, 15 and 17 provide the strip 7 with reduced mass and points of low inertia. With this arrangement, tension on the strip 7 is substantially reduced. By providing the strip 7 with points of low inertia, the strip 7 exhibits elastic rebounding characteristics. This permits the outer edge or contour 17 of the gap strip 7 to receive and absorb the pulse-like forces and elastically rebound to its initial configuration. The pulse-like forces are not transmitted to the cylinder 1. By providing the cooperating cylinders 1 and 3 with the elastic gap strips 7 and 11 it is possible to maintain to a large extent a constant roll-off pressure between the two cylinders 1 and 3 in the area of the cylinder gaps, even given a varying surface resilience as determined by the characteristics of the transfer blankets and printing plates.

The slits 13, 15 and 17 serve to reduce the mass of the gap strip and provide zones or points of low inertia, particularly at the outer-contour or edge 17 of the gap strip. It should also be understood that a reduction in the mass of the gap strip can also be achieved by providing the strip with any arrangement of perforations, as well as, recesses in the body of the strip. In addition, the cross-sectional thickness of the strip at the outer-contour 17 can be reduced to provide a reduced mass of the strip with increased flexibility resulting therefrom. In all of the cases, the gap strip is provided with the ability to elastically deform and rebound in the area of the cylinder gap in response to pulse-like forces.

In FIG. 4, in order to prevent a zone 14 of the gap strip 7 from breaking off as a result of defective material and to be ejected from the gap strip, in the end region of the respective zone 14 there is provided in the inner part 30 of the gap strip 7 hooks 26 which are held by catches 27, extending from the zones 14. Between the individual zones 14, the inner part 30 of the gap strip 7 is provided with T-shaped dogs 28 which are hooked in catches provided at the zones 14.

In summary, one feature of the invention resides broadly in a printing unit cylinder for a rotary printing machine comprising a gap strip 7 arranged in a cylinder gap 6 of the printing unit cylinder 1. The gap strip 7 is supported on the bottom of the cylinder gap 6 and being removably fastened in the cylinder gap 6 via a fastening means 19. The elevation of the gap strip is designed such that gap strips 7 and 11 of two cooperating cylinders 1 and 3 come into contact with each other. The gap strip 7 is designed as a plate and is divided into individual zones 14 by means of transversely extending slits 13. The zones 14 each include longitudinal slits 15 and 16 which permit elastic rebounding of an outer contour 17 of the gap strip 7 when two gap strips 7 and 11 come into contact with each other.

Another feature of the invention resides in a printing unit cylinder having an elastic cover or gap strip divided in zones 14 by slits 13 which intersect longitudinal slits 15. The length of each of the longitudinal slits 15 and 16 corresponds to the support pressure required for the flexible transfer blanket or printing plate on the cylinder.

Yet another feature of the invention resides broadly in a printing unit cylinder having a gap strip 7 with longitudinal slits 15 and 16 which are longer in end regions 18 than they are in the middle of the gap strip so that the support pressure adapts itself to the cylinder deflection.

A further feature of the invention resides broadly in a printing unit cylinder which is characterized in that the gap strip 7 extends from the middle region, seen in the longitudinal direction of the cylinder, to at least over half the cylinder length and projects between about 0.2 to 0.25 mm beyond the theoretical cylinder diameter.

A yet further feature of the invention resides broadly in a printing unit cylinder which is characterized in that on the bottom 8 of the cylinder gap 6 there are secured retaining springs 19 in which the gap strip 7 may be inserted.

Yet another feature of the invention resides broadly in a printing unit cylinder which is characterized in that in order to reduce the tension in the gap strip, the end regions of the slits 15 and 16 are provided with recesses 24 and 25.

An additional feature of the invention resides broadly in a printing unit cylinder which is characterized in that the end regions of the gap strip are provided with hooks 26. Between the individual zones 14, there are provided T-shaped dogs 28. The hooks 26 and the dogs 28 engage the catches 27 and 29 respectively.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicants' option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A printing unit cylinder for a rotary printing press, comprising:

a cylinder having a surface positioned to coact with a surface of an adjacently positioned cylinder of the rotary printing press;

said surface having a gap extending longitudinally on the cylinder, said gap having an open upper end portion at said surface and a bottom end portion;

a gap strip positioned in said gap, said gap strip having a body portion with an upper edge portion;

fastening means positioned in said gap bottom end portion for removably retaining said gap strip in said gap to extend said gap strip upper edge portion to an elevation above said cylinder surface for interaction with a gap strip on the adjacently positioned cylinder; and means positioned on said gap strip upper edge portion for reducing the mass of said gap strip and providing points of low inertia on said gap strip to permit elastic deformation of said gap strip at least in a substantially radial direction of said cylinder and absorb vibrations in response to pressure applied to said cylinder.

2. A plate unit cylinder according to claim 1, wherein said gap strip body portion is a plate divided into a plurality of zones positioned longitudinally at said upper edge portion; and means for separating said zones one from another to allow elastic rebounding of said upper edge portion of said gap strip when gap strips of adjacently positioned cylinders come into contact with each other.

3. A plate unit cylinder according to claim 2, wherein said means for separating said zones includes slits extending transversely in said plate from said upper edge portion into said body portion.

4. A plate unit cylinder according to claim 3, wherein said means for reducing the mass of said gap strip include a plurality of slits extending longitudinally in said body portion;

said longitudinal slits having a predetermined length corresponding to a preselected surface resilience of a flexible blanket positioned on said cylinder surface; and said transversely extending slits come into contact with selected ones of said longitudinal slits.

5. A plate cylinder according to claim 4, wherein said gap strip having opposite end portions and a middle portion therebetween; and said longitudinal slits positioned adjacent said end portions having a length greater than said longitudinal strips positioned in said middle portion to permit increased elastic deformation of said gap strip at said opposite end portions.

6. A plate cylinder according to claim 5, wherein said gap strip is located centrally in said gap and extends over half the length of said cylinder; and said gap strip upper edge portion projects between about 0.2 to 0.25 mm beyond the surface of said cylinder.

7. A plate cylinder according to claim 1, wherein said fastening means includes a retaining spring secured to said gap bottom end portion; and said retaining spring including spring members for engaging said gap strip body portion.

8. A plate unit cylinder according to claim 4, which includes means for reducing the tension in said gap strip upper edge portion by providing recesses in said gap strip at the ends of said longitudinally extending slits.

9. A plate unit cylinder according to claim 2, which includes;

a plurality of hooks located on said gap strip oppositely of said zones;

said zones including catch elements at ends thereof; and said hooks engaging said catch elements to permit relative elastic deformation of said zones on said gap strip.

10. A transfer cylinder for rotary printing press with an axial groove on the surface of said cylinder comprising:

a strip of resilient material positioned in said groove;

said strip having an outer portion and an inner portion;

fastening means for releasably securing said strip inner portion in said groove;

said outer portion extending from said groove; and means positioned on said strip outer portion for resiliently supporting said strip on said cylinder in the area of said groove to permit deflection of said strip at least in a substantially radial direction of said cylinder to absorb vibrations in response to pressure applied to said cylinder in the operation of the rotary printing press.

11. A transfer cylinder according to claim 10 which includes;

a plurality of points of low inertia located on said strip outer portion;

said points of low inertia being positioned longitudinally on said strip; and said points of low inertia providing areas of reduced mass on said strip to release tension in said strip and allow elastic rebounding of said strip in response to vibrations imparted to the cylinder.

12. A transfer cylinder according to claim 10, wherein said strip has a plate-like body portion with an upper edge portion;

said plate-like portion including a plurality of recessed areas spaced longitudinally along said upper edge portion; and said recessed areas providing said strip with elasticity to absorb shocks and vibrations applied to said cylinder at said groove.

13. A transfer cylinder according to claim 10, wherein said means for resiliently supporting said strip on said cylinder includes perforations in said strip positioned randomly, longitudinally on said outer portion; and said perforations providing said strip with points of low inertia to reduce tension on said strip.

14. A transfer cylinder according to claim 10, wherein said strip has a plate-like body portion divided into zones longitudinally on said strip; and said zones being divided from one another by points of low inertia to permit relative movement of said zone strips in absorbing vibrations applied to said strip.

15. A transfer cylinder according to claim 1; wherein said strip includes means for releasing tension applied to said strip.

16. A method for resiliently supporting a gap strip on the surface of a transfer cylinder for a rotary printing press, comprising the steps of:

removably supporting a gap strip in a gap extending longitudinally on the surface of a transfer cylinder, said gap strip having an outer portion and an inner portion;

projecting an upper edge of the gap strip from the gap above the surface of the transfer cylinder for interaction with a gap strip of an adjacently positioned cylinder of the rotary printing press;

providing means positioned on said strip outer portion for resiliently supporting said strip on said cylinder in the area of said groove to permit deflection of said strip at least in a substantially radial direction of said cylinder to absorb vibrations;

flexing of zones of the gap strip relative to one another above the gap; and absorbing vibration imparted to the transfer cylinder from the adjacently positioned cylinder in the operation of the rotary printing press by elastic movement of the zones of the gap strip.

17. A method according to claim 16 including;

independently moving the zones on the gap strip to relieve tension applied to the strip.

18. A method according to claim 16 including;

elastically rebonding the upper edge of the gap strip when two gap strips of adjacently positioned transfer cylinder comes in contact with one another.

19. A method according to claim 16 including;

elastically deforming the upper edge of the gap strip in response to pulse-like forces applied to the transfer cylinder to isolate the transfer cylinder from shocks and vibrations.

20. A method according to claim 16 including;

resiliently supporting a lower edge of the gap strip in the gap.

* * * * *